US008580017B2

(12) United States Patent
Noh et al.

(10) Patent No.: US 8,580,017 B2
(45) Date of Patent: Nov. 12, 2013

(54) ELECTROSTATIC PRECIPITATOR

(75) Inventors: Hyong Soo Noh, Yongin-si (KR); Kochiyama Yasuhiko, Seongnam-si (KR); So Young Yun, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/487,420

(22) Filed: Jun. 4, 2012

(65) Prior Publication Data

US 2012/0312170 A1 Dec. 13, 2012

(30) Foreign Application Priority Data

Jun. 10, 2011 (KR) ..... 10-2011-0055953

(51) Int. Cl.
*B03C 3/47* (2006.01)

(52) U.S. Cl.
USPC ..... 96/69; 96/79; 96/83; 96/87; 96/88; 96/98

(58) Field of Classification Search
USPC ..... 96/69, 75–79, 83, 84, 86–88, 96, 98, 96/99; 95/79
See application file for complete search history.

(56) References Cited

U.S. PATENT DOCUMENTS

| | | | | | |
|---|---|---|---|---|---|
| 2,528,842 | A | * | 11/1950 | Penney | 96/86 |
| 2,970,670 | A | * | 2/1961 | Nodolf | 96/79 |
| 3,026,964 | A | * | 3/1962 | Penney | 96/74 |
| 3,518,462 | A | * | 6/1970 | Brown | 310/10 |
| 3,849,090 | A | * | 11/1974 | Remick | 96/86 |
| 4,231,766 | A | * | 11/1980 | Spurgin | 96/79 |
| 5,290,343 | A | * | 3/1994 | Morita et al. | 96/39 |
| 5,302,190 | A | * | 4/1994 | Williams | 95/57 |
| 5,466,279 | A | * | 11/1995 | Hattori et al. | 96/69 |
| 5,766,318 | A | * | 6/1998 | Loreth et al. | 96/69 |
| 5,993,521 | A | * | 11/1999 | Loreth et al. | 96/69 |
| 6,090,189 | A | * | 7/2000 | Wikstrom et al. | 96/69 |
| 6,251,171 | B1 | * | 6/2001 | Marra et al. | 96/69 |
| 7,077,890 | B2 | * | 7/2006 | Botvinnik | 96/69 |
| 2005/0051028 | A1 | * | 3/2005 | Botvinnik | 96/88 |
| 2008/0314250 | A1 | * | 12/2008 | Cowie et al. | 96/86 |

FOREIGN PATENT DOCUMENTS

| | | | | | |
|---|---|---|---|---|---|
| JP | 4-171064 | A | * | 6/1992 | 96/96 |

* cited by examiner

*Primary Examiner* — Richard L Chiesa
(74) *Attorney, Agent, or Firm* — Staas & Halsey LLP

(57) ABSTRACT

An electrostatic precipitator including a charger to charge dust particles in air and a collector to collect the dust particles. The collector includes a collector case including high-voltage electrodes, to which high-voltage is applied, low-voltage electrodes alternately stacked with the high-voltage electrodes so as to be grounded, and first electrode support elements to support the high-voltage and low-voltage electrodes with a distance therebetween. The first electrode support elements include electrode contact terminals to support extreme edge portions of the high-voltage and low-voltage electrodes. The high-voltage and low-voltage electrodes are formed of a conductive material, or a non-conductive material, the surface of which is subjected to conductive treatment. The electrode contact terminals for the high-voltage electrodes are formed of a semiconductive material. Accordingly, it is possible to maintain a constant distance between the electrodes and to prevent insulation breakdown without deterioration in the performance of the collector.

22 Claims, 16 Drawing Sheets

ELECTROSTATIC PRECIPITATOR

CROSS-REFERENCE TO RELATED APPLICATIONS

This application claims the benefit of Korean Patent Application No. 10-2011-0055953, filed on Jun. 10, 2011 in the Korean Intellectual Property Office, the disclosure of which is incorporated herein by reference.

BACKGROUND

1. Field

Embodiments of the present disclosure relate to an electrostatic precipitator having manufacturability at lower cost and high precipitation efficiency.

2. Description of the Related Art

Generally, an electrostatic precipitator is installed in electronic appliances, such as, e.g., an air conditioner and air purifier, as well as precipitation facilities for buildings and industrial uses. The electrostatic precipitator serves to purify air by collecting contaminants, such as dust, etc., contained in the air.

Most electrostatic precipitators employ a two-stage electrostatic precipitation method using a charger and a collector separated from each other. In the most general configuration, the collector includes alternately arranged high-voltage electrodes and low-voltage electrodes to create an electric field.

However, once captured dust has been accumulated on surfaces of the electrodes, electric current momentarily may flow from the conductive electrodes to the accumulated dust, causing insulation breakdown or discharge between the electrodes. Alarm sounds to inform the insulation breakdown or discharge may be generated.

To prevent the aforementioned phenomenon, one surface or both surfaces of the conductive electrode are coated with an insulator (e.g., plastic resin). Also, to maintain a constant distance between the high-voltage electrode and the low-voltage electrode, a spacer or protrusion is provided at one side of the high-voltage electrode or one side of the low-voltage electrode.

In the case of coating all the high-voltage and low-voltage electrodes of the collector with plastic resin, although it may be effective in terms of preventing insulation breakdown, the high-voltage electrode coated with plastic resin exhibits deterioration in surface potential and the low-voltage electrode coated with plastic resin exhibits increase in surface potential, which may substantially deteriorate performance (precipitation efficiency) of the collector.

Here, although it may be proposed to reduce the resistance of plastic resin coated on the high-voltage electrodes and low-voltage electrodes for improvement of precipitation efficiency, this may increase leakage of current flowing through spacers or bosses, requiring increase in the output of a power device and resulting in loss of electricity.

SUMMARY

Therefore, it is an aspect of the present disclosure to provide an electrostatic precipitator, which achieves high precipitation efficiency even with a sufficient distance between electrodes of a collector through changes in the configuration and material of the collector.

It is another aspect of the present disclosure to provide an electrostatic precipitator, which may achieve reduction in manufacturing costs through changes in the configuration and material of a collector.

Additional aspects of the disclosure will be set forth in part in the description which follows and, in part, will be apparent from the description, or may be learned by practice of the disclosure.

In accordance with one aspect of the present disclosure, an electrostatic precipitator includes a charger to charge dust particles in air and a collector to collect the dust particles charged in the charger, wherein the collector includes a collector case which is provided with a plurality of high-voltage electrodes, to which high-voltage is applied, a plurality of low-voltage electrodes alternately stacked with the high-voltage electrodes so as to be grounded, first electrode support elements to support the high-voltage electrodes and low-voltage electrodes with a predetermined distance between the high-voltage electrode and the low-voltage electrode, and electrode contact terminals to support extreme edge portions of the high-voltage electrodes and low-voltage electrodes, and wherein the high-voltage electrodes and low-voltage electrodes are formed of a conductive material, or a non-conductive material, the surface of which is subjected to conductive treatment, and the electrode contact terminals for the high-voltage electrodes are formed of a semiconductive material.

The electrostatic precipitator may further include a power connection terminal located to come into contact with the electrode contact terminals for the high-voltage electrodes to supply power to the high-voltage electrodes, and the power supplied through the power connection terminal may be transmitted to the high-voltage electrodes via the electrode contact terminals for the high-voltage electrodes.

The semiconductive material may have a volume resistance of about $10^3$ Ω-cm~$10^{11}$ Ω-cm.

The electrostatic precipitator may further include an intermediate partition having second electrode support elements to support the high-voltage electrodes and low-voltage electrodes with a predetermined distance between the high-voltage electrode and the low-voltage electrode.

The first electrode support elements may include a plurality of first-A support bosses to support main portions of the high-voltage electrodes and low-voltage electrodes.

The first electrode support elements may include a plurality of first-B support bosses to selectively support edge portions of the high-voltage electrodes and low-voltage electrodes.

The electrostatic precipitator may further include a power connection terminal connected to the low-voltage electrodes to ground the low-voltage electrodes, and the power connection terminal may be coupled to the electrode contact terminals for the low-voltage electrodes.

The first electrode support elements may include a plurality of first-A support bosses to support main portions of the high-voltage electrodes and low-voltage electrodes, and the second electrode support elements may include a plurality of second-A support bosses formed at positions corresponding to the first-A support bosses to support the high-voltage electrodes and low-voltage electrodes.

The electrostatic precipitator may further include a power connection terminal located to come into contact with the electrode contact terminals for the high-voltage electrodes to supply power to the high-voltage electrodes, and the second electrode support elements may include a plurality of second-B support bosses formed at positions corresponding to the electrode contact terminals for the high-voltage electrodes to allow the electrode contact terminals for the high-voltage electrodes and to come into close contact with the high-voltage electrodes.

The electrostatic precipitator may further include a power connection terminal coupled to the electrode contact terminals for the low-voltage electrodes to ground the low-voltage electrodes, and the second electrode support elements may include a plurality of second-B support bosses formed at positions corresponding to the electrode contact terminals for the low-voltage electrodes to allow the power connection terminal to come into close contact with the low-voltage electrodes.

The high-voltage electrodes and low-voltage electrodes may respectively include fixing recesses to assist the electrodes in being secured to the first-A support bosses.

The high-voltage electrodes and low-voltage electrodes may respectively include seating recesses to assist the electrodes in being seated on the first-B support bosses.

The power connection terminal connected to the low-voltage electrodes may include a plurality of fixing bosses attached to the extreme edge portions of the low-voltage electrodes.

The electrode contact terminals for the low-voltage electrodes may be formed of a semiconductive material.

The electrostatic precipitator may further include a power connection terminal coupled to the electrode contact terminals for the low-voltage electrodes to ground the low-voltage electrodes, and the power supplied through the power connection terminal may be transmitted to the low-voltage electrodes via the electrode contact terminals for the low-voltage electrodes.

The semiconductive material may have a volume resistance of about $10^3$ Ω-cm~$10^{11}$ Ω-cm.

The high-voltage electrodes and low-voltage electrodes may take the form of flat plates.

The intermediate partition may be formed of a non-conductive material.

In accordance with another aspect of the present disclosure, an electrostatic precipitator includes a charger to charge dust particles in air and a collector to collect the dust particles charged in the charger, wherein the collector includes a collector case and an intermediate partition, which take the form of a lattice having a plurality of vent holes to define the external appearance of the collector, and a plurality of high-voltage electrodes and low-voltage electrodes alternately stacked one above another between the collector case and the intermediate partition, wherein the collector case includes a frame, a divider to divide the frame into a lattice form, and first electrode support elements integrally protruding from the frame and divider to support the high-voltage electrodes and low-voltage electrodes with a distance between the high-voltage electrode and the low-voltage electrode, wherein the collector case includes a power connection terminal to supply power to the high-voltage electrodes, and an electrode contact terminal to transmit the power supplied through the power connection terminal to each high-voltage electrode, and wherein the high-voltage electrodes and low-voltage electrodes are formed of a conductive material, or a non-conductive material, the surface of which is subjected to conductive treatment, and the electrode contact terminal is formed of a semiconductive material.

The intermediate partition may include a rim portion, a reinforcing portion to shape the intermediate partition into a lattice form and to increase the strength of the rim portion, and second electrode support elements integrally protruding from the rim portion and reinforcing portion to support the high-voltage electrodes and low-voltage electrodes with a distance between the high-voltage electrode and the low-voltage electrode.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
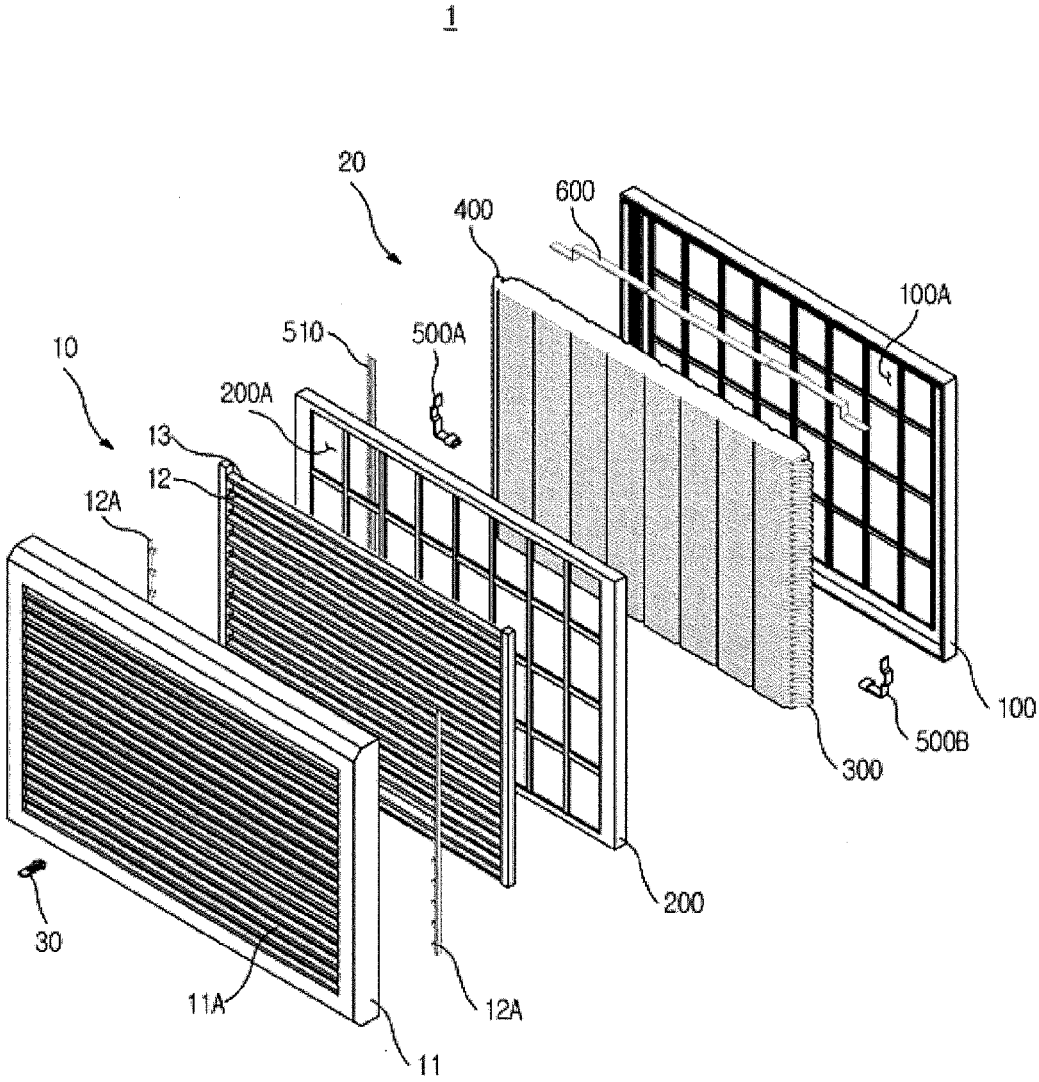
FIG. 1 is an exploded perspective view illustrating an electrostatic precipitator according to an embodiment of the present disclosure.

Reference will now be made in detail to the embodiments of the present disclosure, examples of which are illustrated in the accompanying drawings, wherein like reference numerals refer to like elements throughout.

Figure 2:
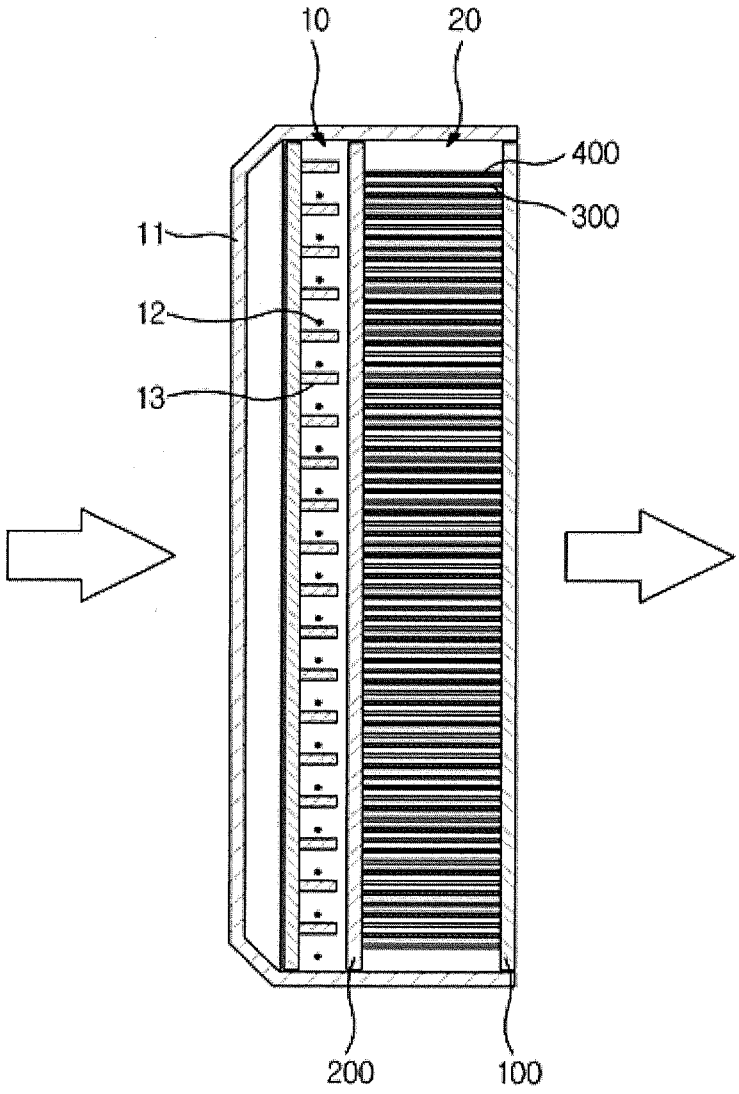
FIG. 2 is a side view of the electrostatic precipitator according to the embodiment of the present disclosure.

FIG. 1 is an exploded perspective view illustrating an electrostatic precipitator according to an embodiment of the present disclosure, and FIG. 2 is a side view of the electrostatic precipitator according to the embodiment of the present disclosure.

As illustrated in FIGS. 1 and 2, the electrostatic precipitator 1 according to the embodiment of the present disclosure includes a charger 10 to ionize dust particles in air, and a collector 20 to collect the dust particles charged by the charger 10.

The charger 10 may include a charger case 11 having suction slots 11A, a discharge electrode 12 which serves as a positive pole via a discharge-electrode power-connection terminal 12A, and a counter electrode 13 which is vertically spaced apart from the discharge electrode 12 by a constant height difference and serves as a negative pole.

If DC voltage is applied to the discharge electrode 12, corona discharge occurs between the discharge electrode 12 and the counter electrode 13. The discharge electrode 12 may include a thin discharge wire 12 formed of a conductive material (e.g., tungsten).

Accordingly, if air is introduced into the electrostatic precipitator 1 through the suction slots 11A and high voltage is applied from a high-voltage power source (not shown) to the discharge wire 12 through the discharge-electrode power-connection terminal 12A, corona discharge occurs as current begins to flow by a high potential difference between the discharge wire 12 and the counter electrode 13. In this way, dust in air that flows in a direction designated by the arrows is electrically charged.

The collector 20 is configured such that high-voltage electrodes 300 and low-voltage electrodes 400 are alternately stacked one above another, to collect the charged dust particles from the charger 10. A detailed configuration of the collector 20 will hereinafter be described with reference to FIGS. 3 to 8B.

Figure 3:
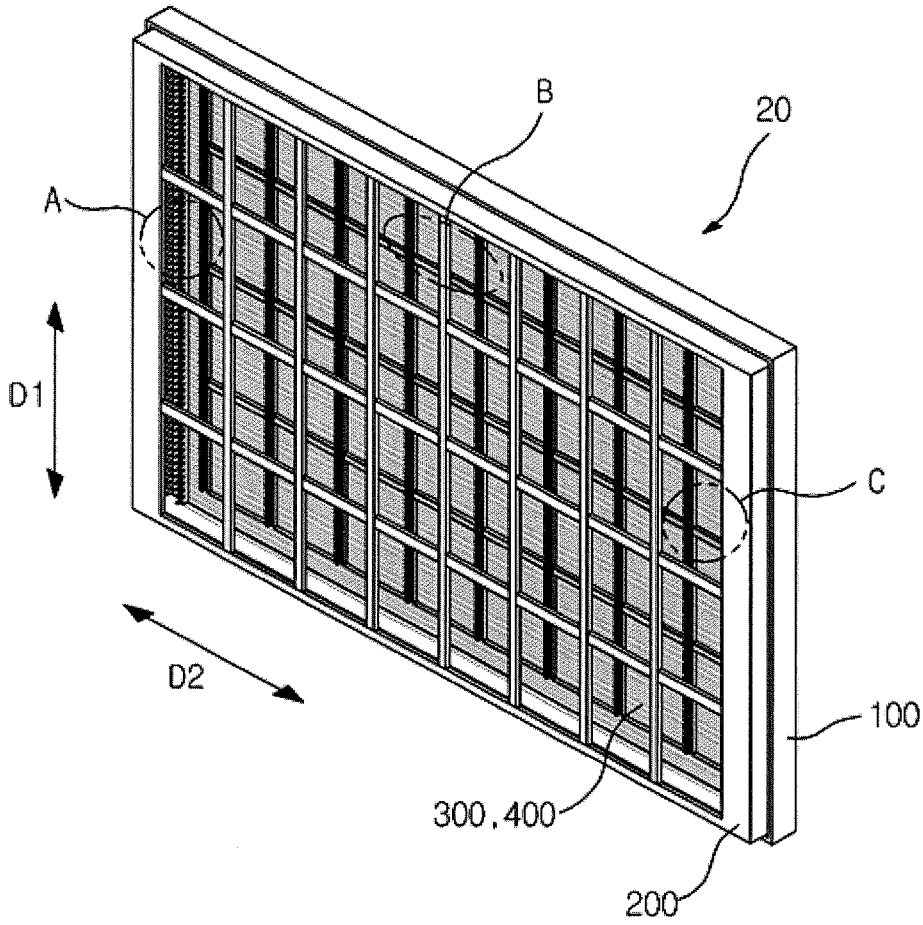
FIG. 3 is a perspective view illustrating a collector included in the electrostatic precipitator according to the embodiment of the present disclosure.
Figure 4A:
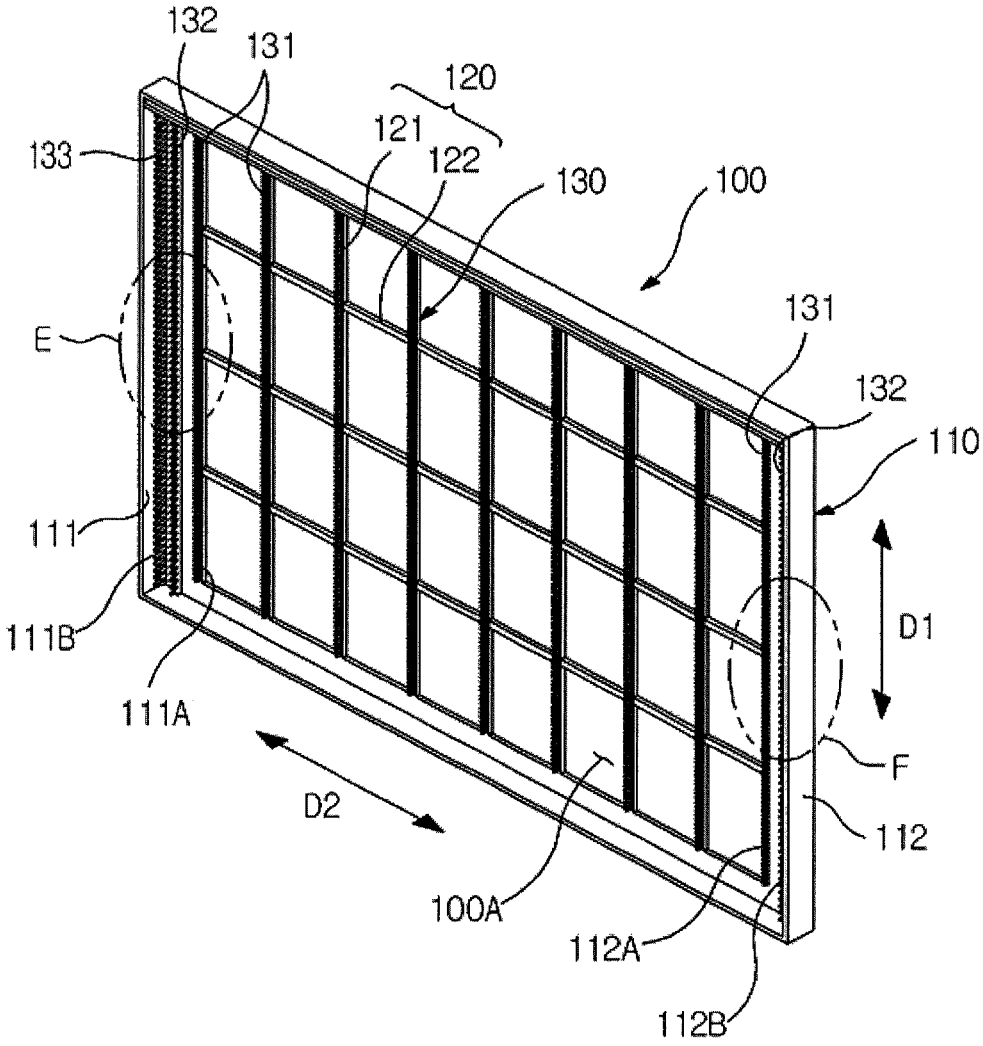
FIG. 4A is an enlarged view illustrating a collector case illustrated in FIG. 3.
Figure 4B:
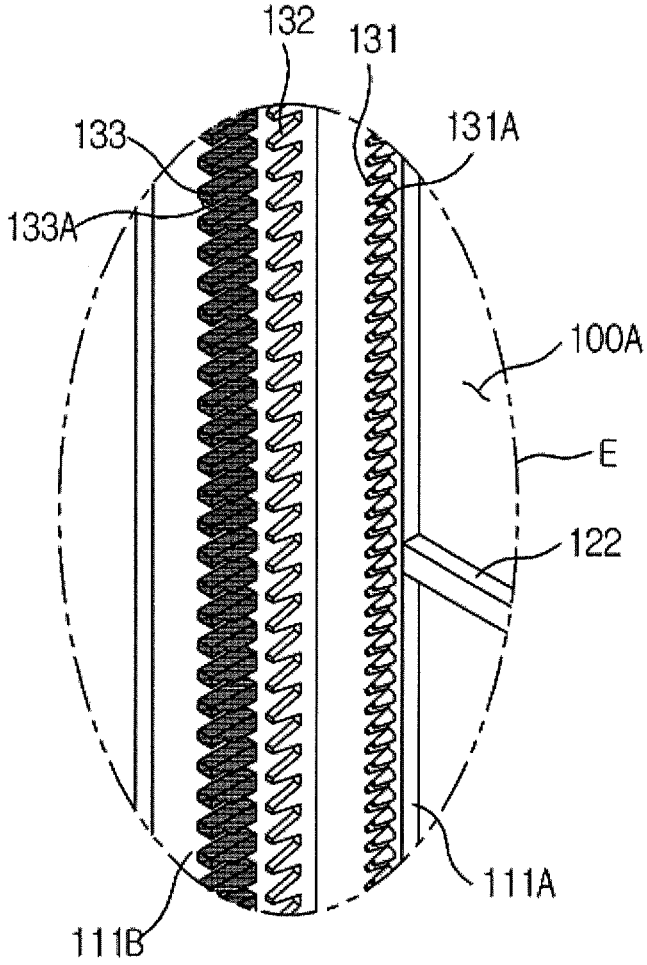
FIG. 4B is an enlarged view illustrating region E illustrated in FIG. 4A.
Figure 4C:
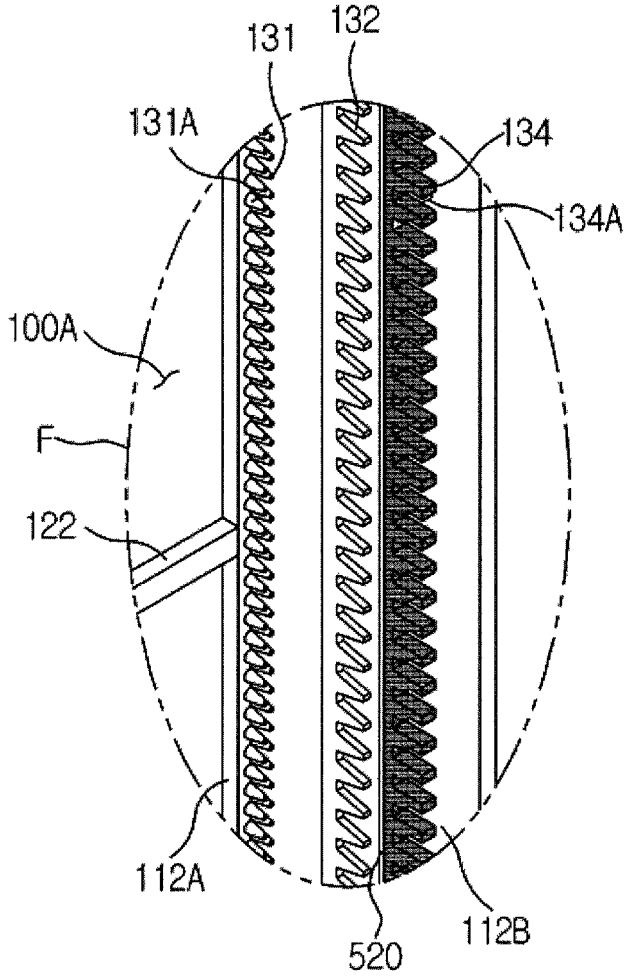
FIG. 4C is an enlarged view illustrating region F illustrated in FIG. 4A.
Figure 5A:
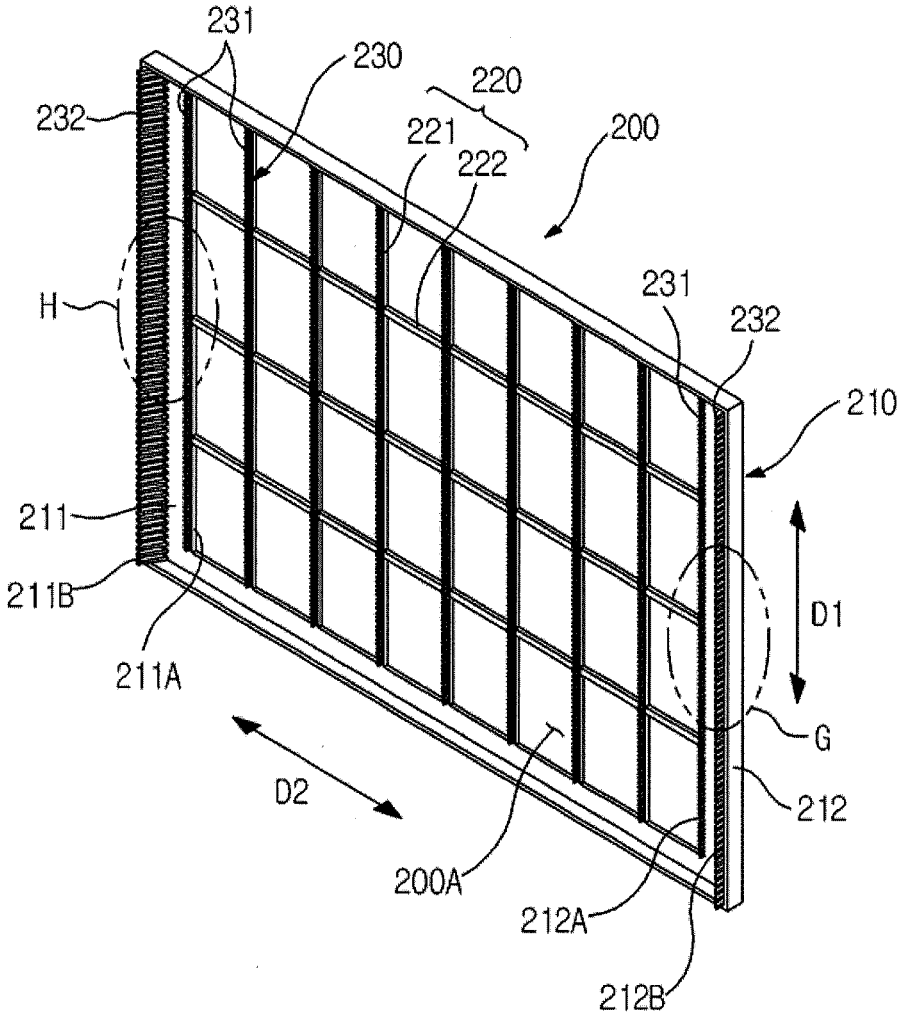
FIG. 5A is an enlarged view illustrating an intermediate partition illustrated in FIG. 3.
Figure 5B:
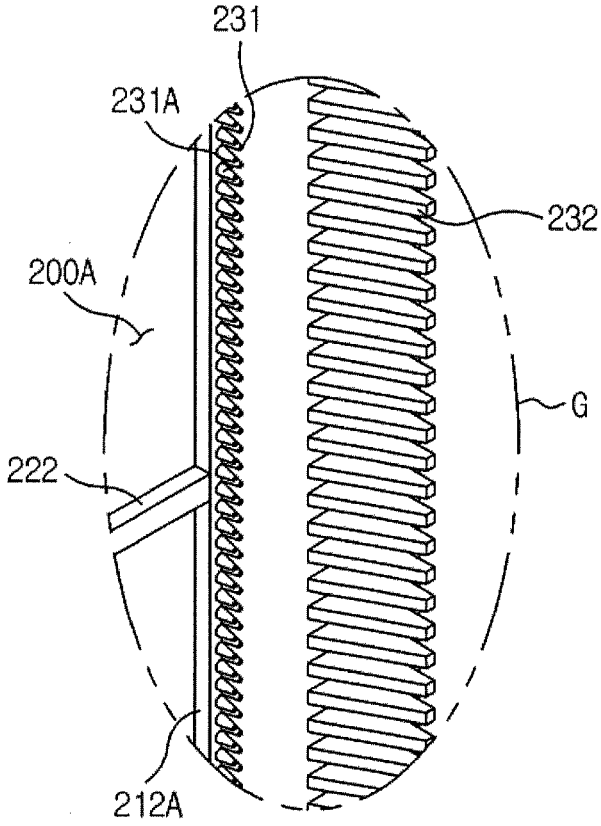
FIG. 5B is an enlarged view illustrating region G illustrated in FIG. 5A.
Figure 5C:
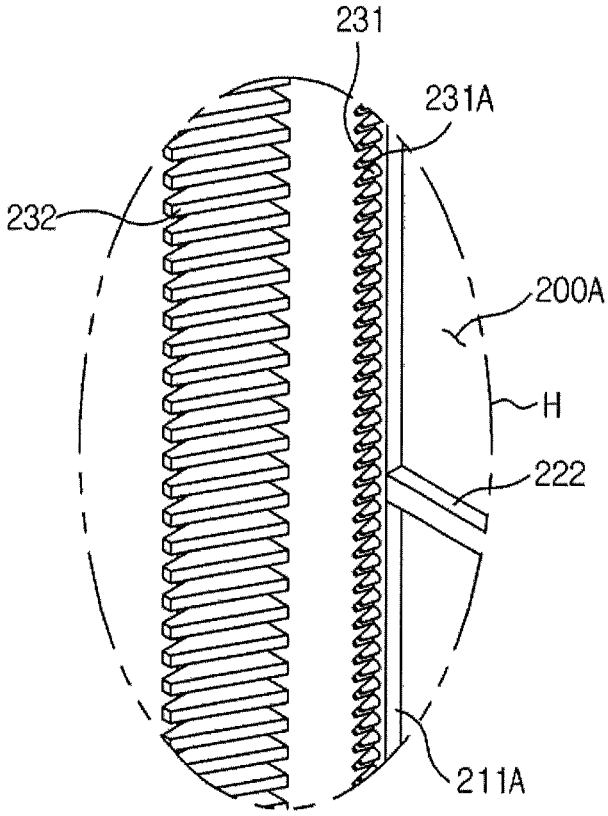
FIG. 5C is an enlarged view illustrating region H illustrated in FIG. 5A.

FIG. 3 is a perspective view illustrating the collector included in the electrostatic precipitator according to the embodiment of the present disclosure, FIG. 4A is an enlarged view illustrating a collector case illustrated in FIG. 3, and FIGS. 4B and 4C are enlarged views respectively illustrating regions E and F illustrated in FIG. 4A. FIG. 5A is an enlarged view illustrating an intermediate partition illustrated in FIG. 3, FIGS. 5B and 5C are enlarged views respectively illustrating regions G and H illustrated in FIG. 5A, and FIGS. 6A to 6C are enlarged views illustrating regions A, B and C illustrated in FIG. 3.

As illustrated in FIG. 1 and FIGS. 3 to 6C, the collector 20 of the electrostatic precipitator 1 according to the embodiment of the present disclosure includes a collector case 100, an intermediate partition 200, a plurality of high-voltage electrodes 300, a plurality of low-voltage electrodes 400, and power connection terminals 510 and 520. The collector case 100 may be coupled to the charger case 11 to define the external appearance of the electrostatic precipitator 1.

As illustrated in FIG. 4A, the collector case 100 may take the form of a lattice having a plurality of vent holes 100A. For example, the collector case 100 may include a frame 110 and a divider 120. The divider 120 serves not only to divide the interior of the frame 100 into the plurality of vent holes 100A, but also to increase the strength of the frame 110.

The frame 110 may include a first frame 111 illustrated at the left side of FIG. 4A, and a second frame 112 illustrated at the right side of FIG. 4A. Both the first and second frames 111 and 112 extend in an electrode stacking direction D1.

The divider 120 may include at least one first divider 121 extending in the electrode stacking direction D1, and at least one second divider 122 extending in an electrode arrangement direction D2 to intersect with the first divider 121.

The first frame 111, second frame 112, and first divider 121 are provided with first electrode support elements 130. The first electrode support elements 130 are configured to support the plurality of electrodes 300 and 400 while maintaining a constant distance between the electrodes 300 and 400.

The first electrode support elements 130 may include first-A support bosses 131 to support main portions of the electrodes 300 and 400, and first-B support bosses 132 to support edge portions of the electrodes 300 and 400.

The first-A support bosses 131 serve to support the main portions of the electrodes 300 and 400 except for the edge portions thereof so as to maintain a distance between the electrodes 300 and 400. The first-A support bosses 131 are provided at the first divider 121, one end 111A of the first frame 111 adjacent to the vent holes 100A, and one end 112A of the second frame 112 adjacent to the vent holes 100A.

The first-A support bosses 131 may have various forms so long as they function to support the electrodes 300 and 400 and maintain a distance between the electrodes 300 and 400.

Figure 6A:
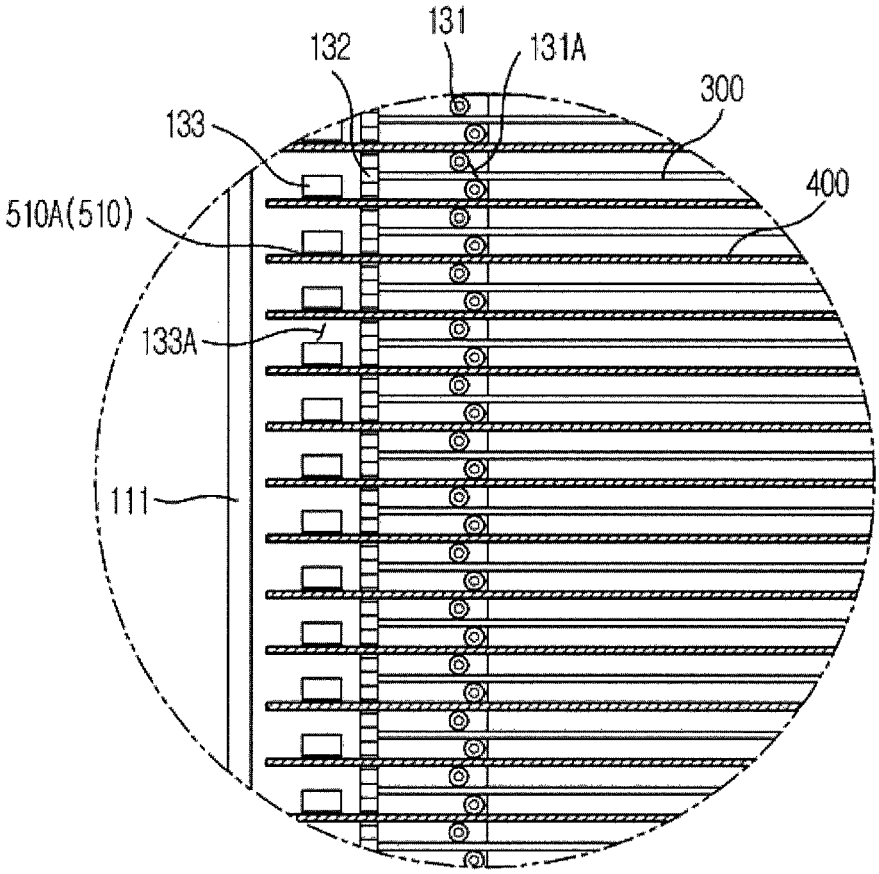
FIG. 6A is an enlarged view illustrating region A illustrated in FIG. 3.
Figure 6B:
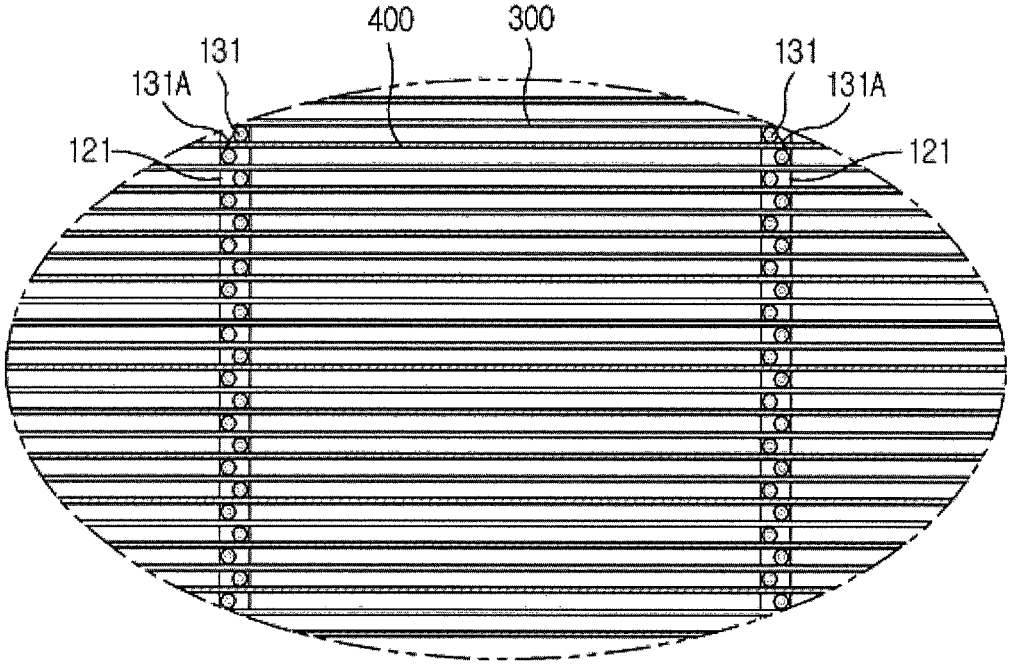
FIG. 6B is an enlarged view illustrating region B illustrated in FIG. 3.
Figure 6C:
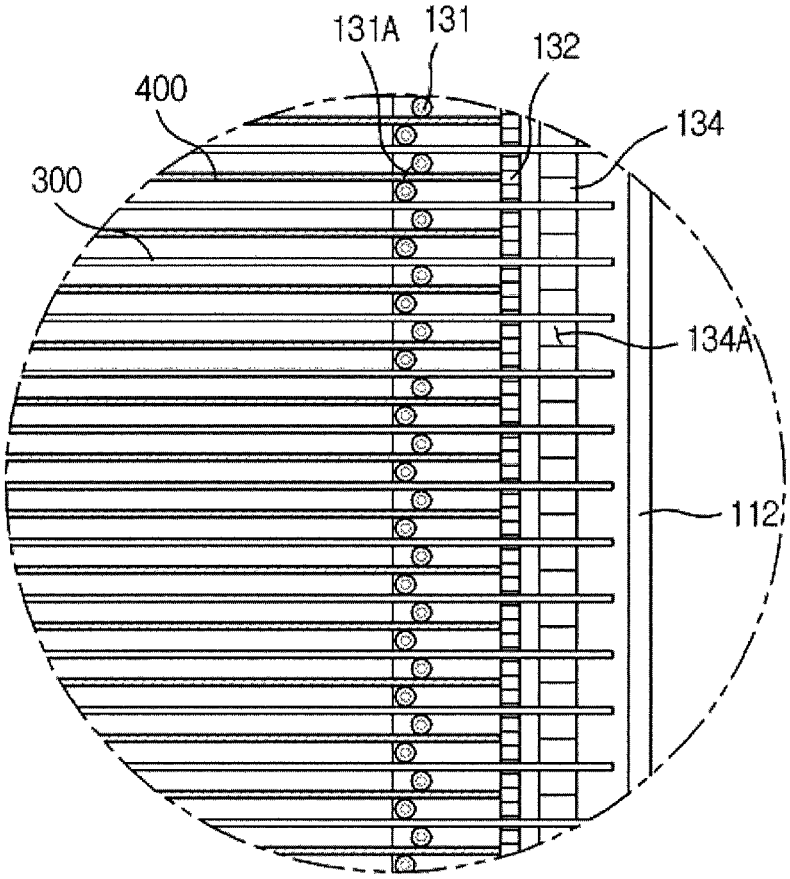
FIG. 6C is an enlarged view illustrating region C illustrated in FIG. 3.

For example, as illustrated in FIGS. 6A to 6C, the first-A support bosses 131 may be arranged in zigzag to define a constant gap 131A between every two first-A support bosses 131 such that each electrode 300 or 400 is supported in the constant gap 131A.

The first-A support bosses 131 may integrally protrude from the ends 111A and 112A of the first and second frames 111 and 112 and from the first divider 121. The first-A support bosses 131 may have a combined form of a cylinder and cone, and of course may be formed into triangular, square, and other polygonal bosses.

The first-B support bosses 132 are provided adjacent to the first-A support bosses 131 to support the edge portions of the electrodes 300 and 400.

The first-B support bosses 132 serve to prevent unnecessary electric interference between the first power connection terminal 510 for the low-voltage electrode 400 that will be described hereinafter and the low-voltage electrode 400 that does not come into close contact with the first power connection terminal 510. The first-B support boss 132 also serves to prevent unnecessary electric interference between a second electrode contact terminal 134 for the high-voltage electrode 300 that will be described hereinafter and the high-voltage electrode 300 that does not come into close contact with the second electrode contact terminal 134.

The first-B support bosses 132 formed at the first frame 111 and the first-B support bosses 132 formed at the second frame 112 may support the different electrodes 300 and 400. For example, as illustrated in FIGS. 6A to 6C, the first-B support bosses 132 formed at the first frame 111 may support only the edge portions of the low-voltage electrodes 400, and the first-B support bosses 132 formed at the second frame 112 may support only the edge portions of the high-voltage electrodes 300.

The first-B support bosses 132 may serve to adjust positions of the electrodes 300 and 400 when the low-voltage electrodes 400 come into close contact with the first power connection terminal 510, or when the high-voltage electrodes 300 come into close contact with the second electrode contact terminals 134.

The first frame 111 and the second frame 112 may be provided with electrode contact terminals 133 and 134 to support extreme edge portions of the electrodes 300 and 400. As illustrated in FIGS. 4B and 6A, the first electrode contact terminals 133 are provided at the other end 111B of the first frame 111 to support the extreme edge portions of the low-voltage electrodes 400. As illustrated in FIGS. 4C and 6C, the second electrode contact terminals 134 are provided at the other end 112B of the second frame 112 to support the extreme edge portions of the high-voltage electrodes 300.

The first power connection terminal 510 is coupled to the first electrode contact terminals 133 provided at the first frame 111.

As illustrated in FIG. 6A, the first power connection terminal 510 is coupled to the first electrode contact terminals 133 formed at the first frame 111 so as to be electrically connected to the low-voltage electrodes 400. A plurality of fixing bosses 510A protrudes from the first power connection terminal 510. The fixing bosses 510A are coupled respectively to the first electrode contact terminals 133 so as to come into contact with only the extreme edge portions of the low-voltage electrodes 400.

Meanwhile, the second power connection terminal 520 is coupled to the second electrode contact terminals 134 formed at the second frame 112.

Figure 7:
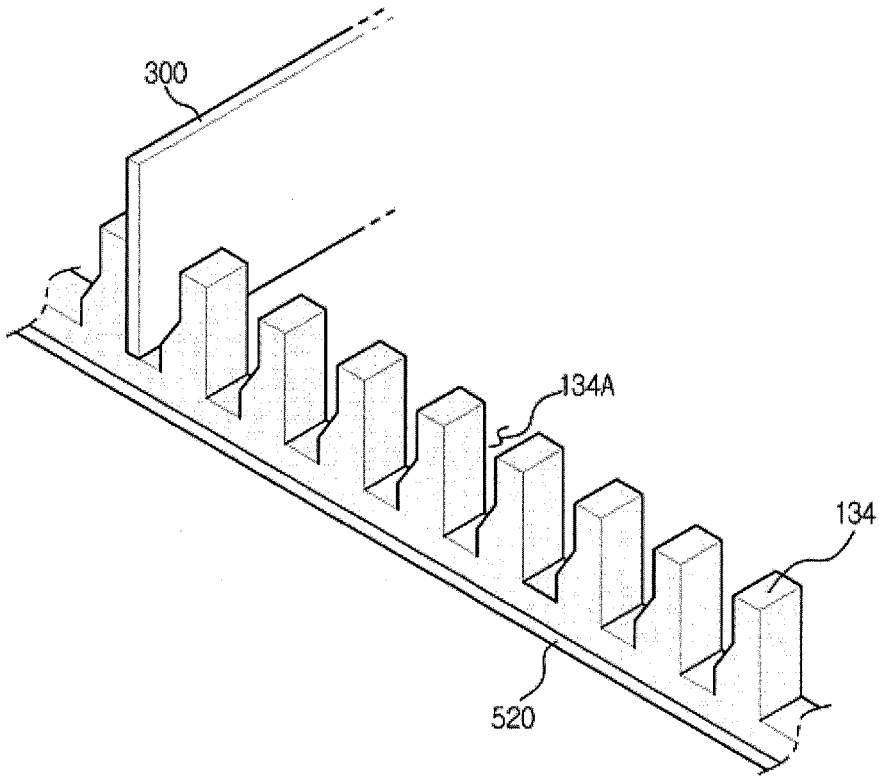
FIG. 7 is a view illustrating the power connection terminal and electrode connection terminals for the high-voltage electrodes.

As illustrated in FIGS. 4C, 6C and 7, the second power connection terminal 520 is coupled to the bottom of the second electrode contact terminals 134 formed at the second frame 112 to supply power to the high-voltage electrodes 300. The second power connection terminal 520 is positioned to come into contact with all the second electrode contact terminals 134 that support the extreme edge portions of the high-voltage electrodes 300, so as not to come into contact with the high-voltage electrodes 300. In this case, the second power connection terminal 520 and second electrode contact terminals 134 have a minimum contact resistance at their contact surfaces. Also, the second electrode contact terminals 134 and high-voltage electrodes 300, which come into contact with each other, have a minimum contact resistance at their contact surfaces. The second electrode contact terminals 134 are formed of a semiconductive material with properties intermediate between a conductor and an insulator. A material having a volume resistance of $10^3$ Ω-cm~$10^{11}$ Ω-cm is used as the semiconductive material of the second electrode contact terminals 134. The second electrode contact terminals 134, formed of the semiconductive material, function to transmit only high-voltage potential applied from a separate high-voltage power source (not shown) to the high-voltage electrodes 300 through the second power connection terminal 520, but does not transmit current to the high-voltage electrodes 300. Thereby, no current is transmitted to the high-voltage electrodes 300 even if high voltage of a few kV is applied to the high-voltage electrodes, and therefore flow of current from the high-voltage electrodes 300 to the low-voltage electrodes 400, i.e. generation of sparks does not occur. Through this feature, it may be possible to prevent electric discharge between the high-voltage electrodes 300 and the low-voltage electrodes 400 even if the high-voltage electrodes 300 are formed of a conductive material, such as a metal.

In the present embodiment, as illustrated in FIG. 7, although the second power connection terminal 520 to supply power to the high-voltage electrodes 300 has been described as being coupled to the bottom of the second electrode contact terminals 134 by way of example, the position of the second power connection terminals 520 may be freely determined so long as it can provide the high-voltage electrodes 300 with even potential without coming into contact with the high-voltage electrodes 300.

Figure 4D:
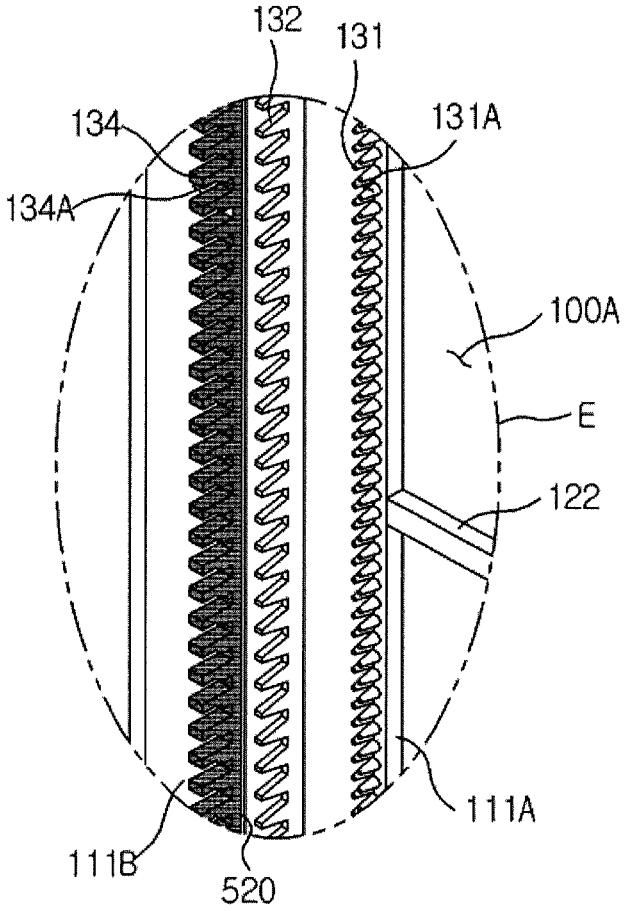
FIG. 4D is an enlarged view illustrating region E illustrated in FIG. 4A according to an alternative embodiment.

Also, in the present embodiment, the low-voltage electrodes 400 have been described as directly coming into contact with the power connection terminal 510 to ground the low-voltage electrodes 400 and the high-voltage electrodes 300 have been described as not directly coming into contact with the power connection terminal 520 such that only high-voltage potential applied through the power connection terminal 520 is transmitted to the high-voltage electrodes 300 through the second electrode contact terminals 134 formed of the semiconductive material by way of example. However, in an alternative embodiment, as shown in FIG. 4D, even the low-voltage electrodes 400 may be configured so as not to directly come into contact with the power connection terminal 510 such that only ground potential (zero volts) applied through the power connection terminal 520 is transmitted to the low-voltage electrodes 400 through the semiconductive second electrode contact terminals 134 and no current is transmitted to the low-voltage electrodes 400.

The intermediate partition 200 may be located between the charger case 11 and the collector case 100 and be coupled to the collector case 100 to define the external appearance of the collector 20. The electrodes 300 and 400 are secured at a constant interval to the intermediate partition 200 as well as the collector case 100.

Similar to the collector case 100, the intermediate partition 200 may take the form of a lattice having a plurality of vent holes 200A. For example, the intermediate partition 200 may include a rim portion 210 and a reinforcing portion 220, and the reinforcing portion 220 may serve not only to divide the interior of the rim portion 210 into the plurality of vent holes 200A, but also to increase the strength of the rim portion 210.

The reinforcing portion 220 may include at least one first reinforcing portion 221 extending in the electrode stacking direction D1, and at least one second reinforcing portion 222 extending in the electrode arrangement direction D2 to intersect with the first reinforcing portion 221.

The rim portion 210 may include a first rim portion 211 illustrated at the left side of FIG. 5A, and a second rim portion 212 illustrated at the right side of FIG. 5A. Both the first and second rim portions 211 and 212 extend in the electrode stacking direction D1. Meanwhile, the first rim portion 211 corresponds to the second frame 112 of the collector case 100, and the second rim portion 212 corresponds to the first frame 111 of the collector case 100.

The first rim portion 211, second rim portion 212, and first reinforcing portion 221 are provided with second electrode support elements 230. The second electrode support elements 230 are configured to support the plurality of electrodes 300 and 400 while maintaining a constant distance between the electrodes 300 and 400.

The second electrode support elements 230 are arranged at positions corresponding to the first electrode support elements 130 to support the electrodes 300 and 400. The second electrode support elements 230 may include second-A support bosses 231 formed at positions corresponding to the first-A support bosses 131 to support the electrodes 300 and 400, and second-B support bosses 232 formed at positions corresponding to the electrode contact terminals 133 and 134 to ensure that the extreme edge portions of the low-voltage electrodes 400 come into close contact with the first power connection terminal 510 or that the extreme edge portions of the high-voltage electrodes 300 come into close contact with the second electrode contact terminals 134.

The second-A support bosses 231 serve to support the electrodes 300 and 400, along with the first-A support bosses 131. The second-A support bosses 231 are provided at the first reinforcing portion 221, one end 211A of the first rim portion 211 adjacent to the vent holes 200A, and one end 212A of the second rim portion 212 adjacent to the vent holes 200A.

Similar to the first-A support bosses 131, the second-A support bosses 231 may have various forms so long as they function to support the electrodes 300 and 400. For example, to correspond to the first-A support bosses 131, the second-A support bosses 231 may be arranged in zigzag to define a constant gap 231A between every two second-A support bosses 231 such that each electrode 300 or 400 is supported in the constant gap 231A.

The second-A support bosses 231 may integrally protrude from the ends 211A and 212A of the first and second rim portions 211 and 212 and from the first reinforcing portion 221. The second-A support bosses 231 may have a combined form of a cylinder and cone, and of course may be formed into triangular, square, and other polygonal bosses.

As illustrated in FIG. 5B, the second-B support bosses 232 may be configured to be fitted into gaps 133A between the first electrode contact terminals 133 that are formed at the edge portion of the first frame 111 and come into close contact with the fixing bosses 510A of the first power connection terminal 510 to allow the first power connection terminal 510 to come into close contact with the low-voltage electrodes 400.

That is, in a state in which the fixing bosses 510A of the first power connection terminal 510 are coupled to the first electrode contact terminals 133 and the extreme edge portions of the low-voltage electrodes 400 come into close contact with the fixing bosses 510A of the first power connection terminal 510, the second-B support bosses 232 are fitted respectively into the gaps 133A between the first electrode contact terminals 133, which enables firm close contact between the first power connection terminal 510 and the low-voltage electrodes 400.

Meanwhile, as shown in FIG. 5C, the second-B support bosses 232 may be configured to be fitted into gaps 134A between the second electrode contact terminals 134 that are formed at the edge portion of the second frame 112 to allow the second electrode contact terminals 134 to come into close contact with the high-voltage electrodes 300.

That is, in a state in which the second power connection terminal 520 comes into contact with the second electrode contact terminals 134, but does not come into contact with the high-voltage electrodes 300 and the extreme edge portions of the high-voltage electrodes 300 come into close contact with the second power connection terminal 520, the second-B support bosses 232 are fitted respectively into the gaps 134A between the second electrode contact terminals 134, which enables firm close contact between the second power connection terminal 520 and the high-voltage electrodes 300.

Meanwhile, the intermediate partition 200 may be formed of an insulating material and serve to insulate the collector 20 and the charger 10 from each other. In particular, in the embodiment of the present disclosure, since the high-voltage electrodes 300 and low-voltage electrodes 400 of the collector 20 are formed of a conductive material, or are formed of a non-conductive material, the surface of which is subjected to surface treatment, the intermediate partition 200 may prevent flow of current from the conductive electrodes 300 and 400 to the charger 10, thereby ensuring high performance of the collector 20 without voltage drop due to current leakage.

Figure 8A:
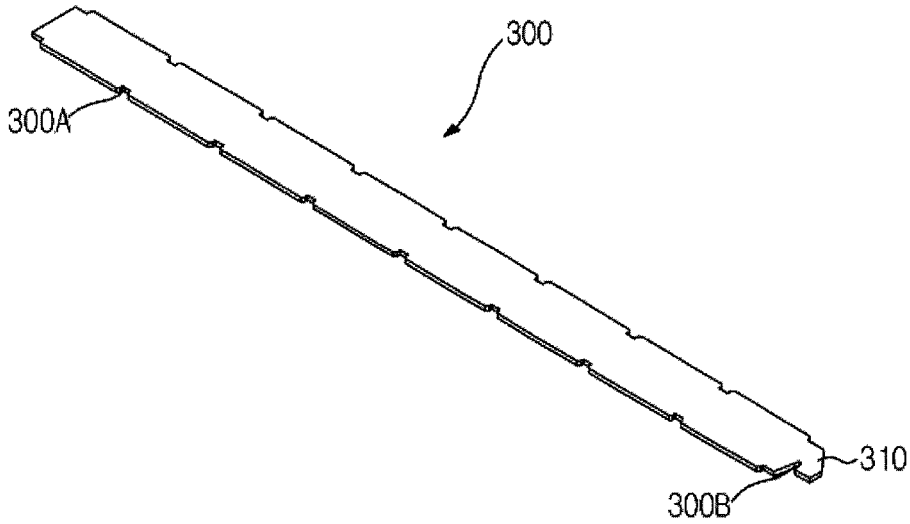
FIG. 8A is a view illustrating a configuration of a high-voltage electrode illustrated in FIG. 3.
Figure 8B:
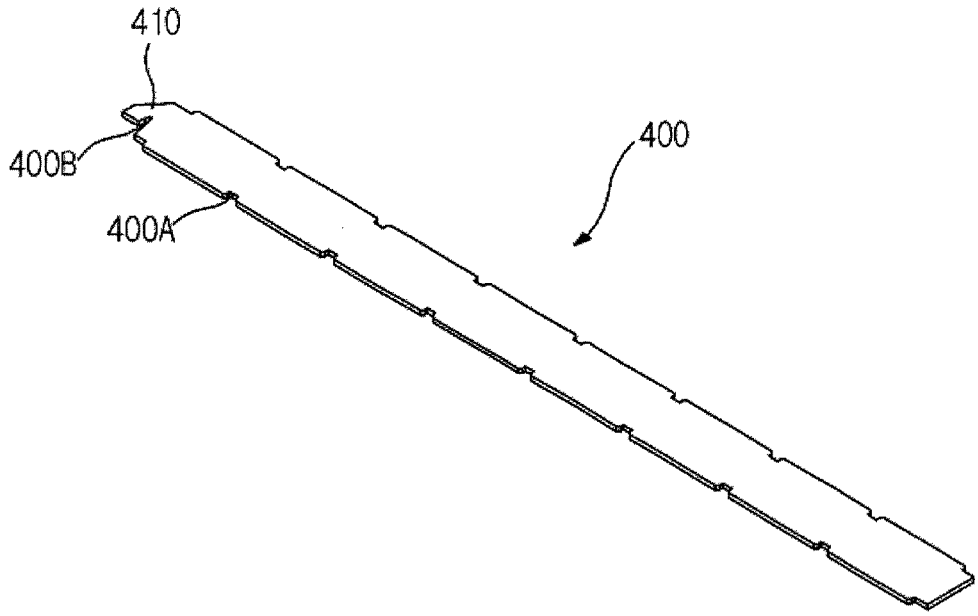
FIG. 8B is a view illustrating a configuration of a low-voltage electrode illustrated in FIG. 3.

FIG. 8A is a view illustrating a configuration of the high-voltage electrode illustrated in FIG. 3, and FIG. 8B is a view illustrating a configuration of the low-voltage electrode illustrated in FIG. 3.

As illustrated in FIG. 8A, the high-voltage electrode 300 is formed of a high electrical conductivity material, for example, a metal, and takes the form of a flat plate. The high-voltage electrode 300 includes a terminal connector 310 connected to the second electrode contact terminal 134. That is, the terminal connector 310 forms the extreme edge portion of the high-voltage electrode 300 and is electrically connected to the second electrode contact terminal 134 coupled to the second frame 112.

The high-voltage electrode 300 has an elongated form and is provided at both longitudinal edges thereof with a plurality of fixing recesses 300A arranged at a constant interval. The fixing recesses 300A assist the high-voltage electrode 300 in being easily stacked on the collector case 100 and intermediate partition 200, and also in being secured to the first-A support boss 131 of the collector case 100 and the second-A support boss 231 of the intermediate partition 200.

The high-voltage electrode 300 is further provided at one end thereof with a seating recess 300B that corresponds to the first-B support boss 132.

Meanwhile, as illustrated in FIG. 8B, the low-voltage electrode 400 is formed of a high electrical conductivity material and takes the form of a flat plate. The low-voltage electrode 400 may be formed of a single metallic film, e.g., a stainless steel (SUS) or aluminum film, so as not to be broken even if minor discharge occurs.

The low-voltage electrode 400 includes a terminal connector 410 connected to the fixing boss 510A of the first power connection terminal 510. That is, the terminal connector 410 forms the extreme edge portion of the low-voltage electrode 400 and is electrically connected to the first power connection terminal 510 coupled to the first frame 111.

The low-voltage electrode 400 has an elongated form and is provided at both longitudinal edges thereof with a plurality of fixing recesses 400A arranged at a constant interval. The fixing recesses 400A assist the low-voltage electrode 400 in being easily stacked on the collector case 100 and the intermediate partition 200, and also in being secured to the first-A support boss 131 of the collector case 100 and the second-A support boss 231 of the intermediate partition 200.

The low-voltage electrode 400 is further provided at one end thereof with a seating recess 400B that corresponds to the first-B support boss 132.

Accordingly, high voltage having positive polarity is applied to the high-voltage electrode 300 through the second power connection terminal 520 and second electrode contact terminal 134, and the low-voltage electrode 400 is connected to an earth through the first power connection terminal 510, to create an electric field.

In conclusion, if corona discharge occurs in the charger 10, charging dust particles in air with positive polarity, the positively charged dust particles are collected by the low-voltage electrodes 400 having negative polarity in the collector 20 under influence of Coulomb force.

Meanwhile, the high-voltage power source (not shown) connected to the second power connection terminal 520 may have positive polarity or negative polarity, and of course may apply a pulse voltage.

Also, the high-voltage electrode 300 and low-voltage electrode 400 may be formed of a conductive material, such as a metal, and also may be formed of a non-conductive material, the surface of which is subjected to conductive treatment.

That is, although formed of a conductive material, the high-voltage electrode 300 and low-voltage electrode 400 may be formed by plating a metal foil or coating a metal material on the surface of a non-conductive material, such as plastics or rubber. For example, after attaching a silver foil to both surfaces of a PET film, the film may be cut into an electrode form.

Although not described, reference numeral 30 represents a hook-shaped clip to improve coupling force between the charger 10 and the collector 20, reference numeral 500A represents a first intermediary terminal to ground the first power connection terminal 510, and reference numeral 500B represents a second intermediary terminal to connect the second power connection terminal 520 to the not-shown high voltage power source.

As is apparent from the above description, according to one aspect of the present disclosure, boss-shaped structures to maintain distances between electrodes are formed at a collector case and an intermediate partition, which may ensure a constant distance between the electrodes and prevent insulation breakdown without deterioration in the performance of a collector.

Further, according to another aspect of the present disclosure, electrodes (high-voltage electrodes and low-voltage electrodes) of the collector are formed of a conductive material, such as a metal, which may reduce manufacturing costs of an electrostatic precipitator.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. An electrostatic precipitator comprising a charger to charge dust particles in air and a collector to collect the dust particles charged in the charger, wherein the collector includes a collector case which is provided with a plurality of high-voltage electrodes, to which high-voltage is applied, a plurality of low-voltage electrodes alternately stacked with the high-voltage electrodes so as to be grounded, first electrode support elements to support the high-voltage electrodes and low-voltage electrodes with a predetermined distance between the high-voltage electrode and the low-voltage electrode, and electrode contact terminals to support extreme edge portions of the high-voltage electrodes and low-voltage electrodes, and wherein the high-voltage electrodes and low-voltage electrodes are formed of a conductive material, or a non-conductive material, the surface of which is subjected to conductive treatment, and the electrode contact terminals for the high-voltage electrodes are formed of a semiconductive material.

2. The electrostatic precipitator according to claim 1, further comprising a power connection terminal located to come into contact with the electrode contact terminals for the high-voltage electrodes to supply power to the high-voltage electrodes, wherein the power supplied through the power connection terminal is transmitted to the high-voltage electrodes via the electrode contact terminals for the high-voltage electrodes.

3. The electrostatic precipitator according to claim 1, wherein the semiconductive material has a volume resistance of about $10^3$ Ω-cm~$10^{11}$ Ω-cm.

4. The electrostatic precipitator according to claim 1, further comprising an intermediate partition having second electrode support elements to support the high-voltage electrodes and low-voltage electrodes with a predetermined distance between the high-voltage electrode and the low-voltage electrode.

5. The electrostatic precipitator according to claim 1, wherein the first electrode support elements include a plurality of first-A support bosses to support main portions of the high-voltage electrodes and low-voltage electrodes.

6. The electrostatic precipitator according to claim 5, wherein the plurality of first-A support bosses is arranged in zigzag to define a constant gap between every two first-A support bosses such that each main portion of the high-voltage electrodes and low-voltage electrodes is supported in the constant gap.

7. The electrostatic precipitator according to claim 1, wherein the first electrode support elements include a plurality of first-B support bosses to selectively support edge portions of the high-voltage electrodes and low-voltage electrodes.

8. The electrostatic precipitator according to claim 1, further comprising a power connection terminal connected to the low-voltage electrodes to ground the low-voltage electrodes, wherein the power connection terminal is coupled to the electrode contact terminals for the low-voltage electrodes.

9. The electrostatic precipitator according to claim 4, wherein the first electrode support elements include a plurality of first-A support bosses to support main portions of the high-voltage electrodes and low-voltage electrodes, and wherein the second electrode support elements include a plurality of second-A support bosses formed at positions corresponding to the first-A support bosses to support the high-voltage electrodes and low-voltage electrodes.

10. The electrostatic precipitator according to claim 9, wherein the plurality of first-A support bosses and second-A support bosses are arranged in zigzag to define a constant gap between every two first-A support bosses and every two second-A support bosses such that each of the high-voltage electrodes and low-voltage electrodes is supported in the constant gap.

11. The electrostatic precipitator according to claim 4, further comprising a power connection terminal located to come into contact with the electrode contact terminals for the high-voltage electrodes to supply power to the high-voltage electrodes, wherein the second electrode support elements include a plurality of second-B support bosses formed at positions corresponding to the electrode contact terminals for the high-voltage electrodes to allow the electrode contact terminals for the high-voltage electrodes and to come into close contact with the high-voltage electrodes.

12. The electrostatic precipitator according to claim 4, further comprising a power connection terminal coupled to the electrode contact terminals for the low-voltage electrodes to ground the low-voltage electrodes, wherein the second electrode support elements include a plurality of second-B support bosses formed at positions corresponding to the electrode contact terminals for the low-voltage electrodes to allow the power connection terminal to come into close contact with the low-voltage electrodes.

13. The electrostatic precipitator according to claim 5, wherein the high-voltage electrodes and low-voltage electrodes respectively include fixing recesses to assist the electrodes in being secured to the first-A support bosses.

14. The electrostatic precipitator according to claim 7, wherein the high-voltage electrodes and low-voltage electrodes respectively include seating recesses to assist the electrodes in being seated on the first-B support bosses.

15. The electrostatic precipitator according to claim 8, wherein the power connection terminal connected to the low-voltage electrodes includes a plurality of fixing bosses attached to the extreme edge portions of the low-voltage electrodes.

16. The electrostatic precipitator according to claim 1, wherein the electrode contact terminals for the low-voltage electrodes are formed of a semiconductive material.

17. The electrostatic precipitator according to claim 16, further comprising a power connection terminal coupled to the electrode contact terminals for the low-voltage electrodes to ground the low-voltage electrodes, wherein the power supplied through the power connection terminal is transmitted to the low-voltage electrodes via the electrode contact terminals for the low-voltage electrodes.

18. The electrostatic precipitator according to claim 16, wherein the semiconductive material has a volume resistance of about $10^3$ Ω-cm~$10^{11}$ Ω-cm.

19. The electrostatic precipitator according to claim 1, wherein the high-voltage electrodes and low-voltage electrodes take the form of flat plates.

20. The electrostatic precipitator according to claim 4, wherein the intermediate partition is formed of a non-conductive material.

21. An electrostatic precipitator comprising a charger to charge dust particles in air and a collector to collect the dust particles charged in the charger, wherein the collector includes a collector case and an intermediate partition, which take the form of a lattice having a plurality of vent holes to define the external appearance of the collector, and a plurality of high-voltage electrodes and low-voltage electrodes alternately stacked one above another between the collector case and the intermediate partition, wherein the collector case includes a frame, a divider to divide the frame into a lattice form, and first electrode support elements integrally protruding from the frame and divider to support the high-voltage electrodes and low-voltage electrodes with a distance between the high-voltage electrode and the low-voltage electrode, wherein the collector case includes a power connection terminal to supply power to the high-voltage electrodes, and an electrode contact terminal to transmit the power supplied through the power connection terminal to each high-voltage electrode, and wherein the high-voltage electrodes and low-voltage electrodes are formed of a conductive material, or a non-conductive material, the surface of which is subjected to conductive treatment, and the electrode contact terminal is formed of a semiconductive material.

22. The electrostatic precipitator according to claim 21, wherein the intermediate partition includes a rim portion, a reinforcing portion to shape the intermediate partition into a lattice form and to increase the strength of the rim portion, and second electrode support elements integrally protruding from the rim portion and reinforcing portion to support the high-voltage electrodes and low-voltage electrodes with a distance between the high-voltage electrode and the low-voltage electrode.

* * * * *